US010180300B2

(12) United States Patent
Schirmer et al.

(10) Patent No.: US 10,180,300 B2
(45) Date of Patent: Jan. 15, 2019

(54) FIREARM RECOIL COMPENSATION

(71) Applicant: STI Firearms, LLC, Georgetown, TX (US)

(72) Inventors: Christopher Schirmer, Georgetown, TX (US); Jeffery Hildner, Belton, TX (US)

(73) Assignee: STI Firearms, LLC, Georgetown, TX (US)

( * ) Notice: Subject to any disclaimer, the term of this patent is extended or adjusted under 35 U.S.C. 154(b) by 34 days.

(21) Appl. No.: 15/684,259

(22) Filed: Aug. 23, 2017

(65) Prior Publication Data

US 2018/0058792 A1 Mar. 1, 2018

Related U.S. Application Data

(60) Provisional application No. 62/379,149, filed on Aug. 24, 2016.

(51) Int. Cl.

| | |
|---|---|
| ***F41A 21/00*** | (2006.01) |
| ***F41A 21/36*** | (2006.01) |
| ***F41A 21/28*** | (2006.01) |

(52) U.S. Cl.

CPC ..... *F41A 21/36* (2013.01); *F41A 21/28* (2013.01)

(58) Field of Classification Search

CPC ..... F41A 21/36; F41A 21/38; F41A 21/28; F41A 21/30

USPC ..... 89/14.3, 14.4

See application file for complete search history.

(56) References Cited

U.S. PATENT DOCUMENTS

| | | | | |
|---|---|---|---|---|
| 4,691,614 | A | 9/1987 | Leffel et al. | |
| 4,715,140 | A | 12/1987 | Rosenwald | |
| 5,325,617 | A * | 7/1994 | Vojta | F41A 11/02 42/75.03 |
| 6,604,445 | B2 * | 8/2003 | Sevastian | F41A 21/36 42/1.06 |

OTHER PUBLICATIONS

Rogersprecision.com' [online]. "Carry Comps," [retrieved on Aug. 22, 2017]. Retrieved from the Internet: URL<http://rogersprecision.com/id10.html>. 5 pages.

(Continued)

*Primary Examiner* — J. Woodrow Eldred
(74) *Attorney, Agent, or Firm* — Fish & Richardson P.C.

(57) ABSTRACT

The subject matter described in this specification relates generally to a firearm recoil compensation system and a process for manufacturing a firearm recoil compensation system. The recoil compensation system includes a barrel, a compensator, and a slide. The compensator is attached to a muzzle end of the barrel. The compensator includes a projection extending along an upper surface of the barrel in a direction away from gas ports in the compensator. The slide is configured to house the barrel, and a slot is defined in an upper surface of the slide, where the slot is shaped to allow the slide to, at least partially, wrap around the projection of the compensator with the slide in a battery position.

20 Claims, 4 Drawing Sheets

(56) References Cited

OTHER PUBLICATIONS

Armlist.com [online]. "For Sale/Trade: Glock 23 With KKM Ported Barrel, Aro-Port Hybrid Compensator and MMC Night Sights," Feb. 10, 2013, Milwaukee Wisconsin [retrieved on Aug. 23, 2017]. Retrieved from the Internet: URL<https://web.archive.org/web/20130213120329/http://www.armslist.com/posts/1038563/milwaukee-wisconsin-handguns-for-sale-trade—glock-23-with-kkm-ported-barrel—aro-port-hybrid-compensator-and-mmc-night-sights-> and URL <'Armlist.com' [online]. "For Sale/Trade: Glock 23 With KKM Ported Barrel, Aro-Port Hybrid Compensator and MMC Night Sights," Feb. 10, 2013, Milwaukee Wisconsin [retrieved on Aug. 23, 2017]. Retrieved from the Internet: URL<https://web.archive.org/web/20130213120329/http://www.armslist.com/posts/1038563/milwaukee-wisconsin-handguns-for-sale-trade--glock-23-with-kkm-ported-barrell--aro-port-hybrid-compensator-and-mmc-night-sights-> and URL< http://www.armslist.com/posts/1038563/milwaukee-wiconsin-handguns-for-sale-trade--glock-23-with-kkm-ported-barrel--aro-port-hybrid-compensator-and-mmc-night-sights-> 3 pages.

Arotek.com [online]. "Aro-Tek Glock Ultimate Competition Package," [retrieved on Aug. 22, 2017]. Retrieved from the Internet: URL<http://www.arotek.com/cfphotogallery/ultcompetpkg.htm>. 2 pages.

* cited by examiner

FIREARM RECOIL COMPENSATION

CROSS-REFERENCE TO RELATED APPLICATION

This application claims the benefit of the filing date of U.S. Provisional Application No. 62/379,149, filed on Aug. 24, 2016. The contents of U.S. Application No. 62/379,149 are incorporated herein by reference in their entirety.

TECHNICAL FIELD

This invention relates to compensation systems for firearms.

BACKGROUND

Firearm compensators reduce the felt recoil of a firearm. Compensators can also reduce the amount of motion of the muzzle or "muzzle rise" during firing, especially for handguns. Some compensators are attached to the end of a firearm's barrel such that the compensator extends away from the slide and frame. In such cases, the compensator may interfere with holstering the firearm. Some handgun compensators are formed by machining gas ports directly in the firearm's slide and barrel. However, in such cases the gas ports are placed between the shooter and the front sight, consequently, gasses escaping from the gas ports may interfere with the shooter's sight picture. Improvements are sought in compensator design to address these and other issues.

SUMMARY

In general, innovative aspects of the subject matter described in this specification include a firearm recoil compensation system. The recoil compensation system includes a barrel, a compensator, and a slide. The compensator is attached to a muzzle end of the barrel. The compensator includes a projection extending along an upper surface of the barrel in a direction away from gas ports in the compensator. The slide is configured to house the barrel, and a slot is defined in an upper surface of the slide, where the slot is shaped to allow the slide to, at least partially, wrap around the projection of the compensator with the slide in a battery position. This and other implementations can each optionally include one or more of the following features.

In some implementations, a sight is mounted to an upper surface of the projection.

In some implementations, the upper surface of the slide is substantially flush with the upper surface of the projection, and side surfaces of the compensator are substantially flush with side surfaces of the slide.

In some implementations, the compensator includes a gas port defined within the upper surface of the compensator. In some implementations, a sight is mounted to an upper surface of the projection where the sight is spaced apart from and rearward of the gas port.

In some implementations, the compensator includes a gas port defined within the upper surface of the compensator and a gas port defined within each of a right side surface and a left side surface of the compensator.

In some implementations, the slot is shaped to allow the slide to completely surround the projection.

A second general aspect can be embodied in a firearm with a recoil compensation system. The firearm includes a frame, a barrel, a compensator, a slide, and a sight. The compensator is attached to a muzzle end of the barrel, and includes a projection extending along an upper surface of the barrel in a direction away from the muzzle end of the barrel. The slide is slidably coupled to the frame and houses the barrel. A slot is defined in an upper surface of the slide where the slot is shaped to allow the slide to, at least partially, wrap around the projection with the slide in a battery position. The sight is mounted to an upper surface of the compensator projection. This and other implementations can each optionally include one or more of the following features.

In some implementations, the upper surface of the slide is substantially flush with the upper surface of the projection.

In some implementations, side surfaces of the compensator are substantially flush with side surfaces of the slide.

In some implementations, the compensator includes a gas port defined within the upper surface of the compensator. In some implementations, the sight is spaced apart from and rearward of the gas port.

In some implementations, the compensator comprises a gas port defined within the upper surface of the compensator, and a gas port defined within each of a right side surface and a left side surface of the compensator.

In some implementations, the slot is shaped to allow the slide to completely surround the projection.

In some implementations, the compensator and barrel are machined together from a single piece of metal.

In some implementations, the compensator is threaded on the barrel.

In some implementations, a portion of the frame extends around a bottom portion of the compensator.

In some implementations, a front surface of the frame is substantially flush with a front surface of the compensator.

In some implementations, the upper surface of the slide is substantially flush with the upper surface of the projection, side surfaces of the compensator are substantially flush with side surfaces of the slide, and a front surface of the frame is substantially flush with a front surface of the compensator.

A third general aspect can be embodied in a process for manufacturing a firearm compensation system. The process includes attaching a compensator to a muzzle end of a barrel, where the compensator includes a projection, and the compensator is attached such that the projection extends along the barrel in a direction that is away from gas ports in the compensator and towards a chamber end of the barrel. The process includes installing the barrel in a slide, where a slot is defined in an upper surface of the slide and the slot is shaped to allow the slide to, at least partially, wrap around the projection with barrel fully inserted in the slide. The process includes mounting a front sight to an upper surface of the projection of the compensator.

The concepts described herein may provide several advantages. For example, implementations of the invention may provide a firearm compensation system that is integral to the firearm so as not to interfere with holstering the firearm. Implementations provide an integral firearm compensation system in which the gasses escaping from the compensation ports do not interfere with the shooter's view of the front sight. Implementations may provide for more consistent and quicker follow up shots due to reduced muzzle rise in the firearm. Implementations may also reduce muzzle rise by a combination of reducing the rearward inertia of the slide during recoil and downward forces on the muzzle from the compensator. Implementations may provide a shooter with a more consistent picture throughout the recoil of the firearm by providing a fixed surface of the compensator on which to mount the front sight rather than on the firearm slide.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
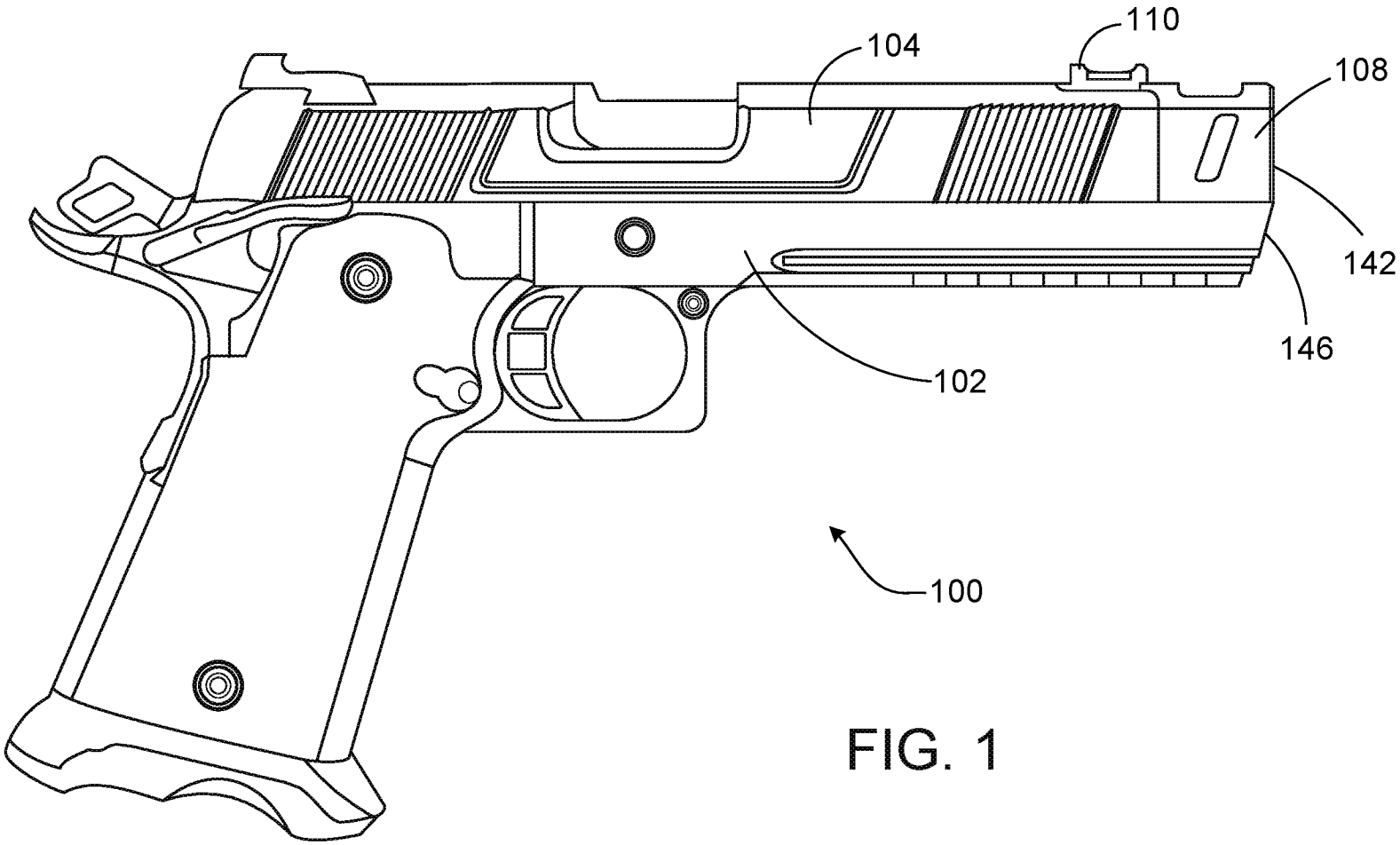
FIG. 1 depicts a side view of a firearm with an integrated compensation system.

Implementations of the present disclosure are generally directed to recoil compensation system for a firearm. The system includes an integrated slide and compensator design. The compensator includes a projection that extends along a firearm barrel away from the muzzle and the gas ports on the compensator. For example, the projection can be formed as an island extending away from the compensator over the top of the barrel. The slide has a slot in the upper surface that is shaped to correspond with the shape of the compensator projection. The compensator projection allows a front sight to be mounted behind the compensator gas ports which prevent escaping gasses and muzzle flash from obscuring the shooter's sight picture. The compensator projection provides a fixed surface of the gun for mounting the front sight on the barrel, rather than on the slide which moves rapidly during the recoil of the firearm, which also may improve the ability for a shooter to follow the front sight through the firearm's recoil. Furthermore, the slot in the slide is shaped to wrap around the compensator projection. Thus, the compensator and projection are integrated with the slide to form a continuous smooth surface, thereby, minimizing edges that might catch on a shooter's clothing or gear. The slot in the slide also reduces the weight of the slide, thereby, creating a corresponding reduction in the slide's momentum during recoil which also may serve to further reduce muzzle rise and felt recoil.

As used herein, the term "semiautomatic firearm" refers to a firearm which automatically extracts a spent cartridge casing and chambers a new round after each shot. The semiautomatic firearm uses a portion of the energy from a firing round to extract a spent cartridge casing from the fired round, cock the firearm, and chamber a new round with each pull of the trigger, but requires a separate pull of the trigger to fire the new round.

As used herein, the terms "orthogonal" or "substantially orthogonal" refer to a relation between two elements (e.g., lines, axes, planes, surfaces, or components) that forms a ninety degree (perpendicular) angle within acceptable engineering, machining, or measurement tolerances. For example, two surfaces can be considered orthogonal to each other if the angle between the surfaces is within an acceptable tolerance of ninety degrees (e.g., ±1-2 degrees).

As used herein, the terms "aligned," "substantially aligned," "parallel," "substantially parallel," "flush," or "substantially flush" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device. Similarly, two surfaces can be considered to be flush or substantially flush if both surfaces generally lie within the same plane, but may a slight offset that is within acceptable tolerances may still exist between the surfaces.

As used herein, the term "recoil forces" refers to forces exerted on various components of a firearm (e.g., breech face, slide, frame, recoil spring) which balance the forward momentum of a projectile being discarded from the firearm. Recoil forces are generally experienced directly at the breach face and transmitted through the breach face to other components of the firearm.

As used herein, terms describing relative directions or orientations (e.g., front, back/rear, distal, proximate, top/upper, bottom/lower) of various elements are used in reference to the perspective of a user holding a firearm. Thus, for example, the distal/front edge or surface of a component refers to that edge or surface of the component that is nearest or facing the muzzle of the firearm when the component properly installed in the firearm. Similarly, for example, the back/proximate edge or surface of a component refers to that edge or surface of the component that is farthest from or facing away from the muzzle of the firearm when the component is properly installed in the firearm. Likewise, for example, the top/upper edge or surface of a component refers to that edge or surface of the component that is nearest or facing the top of the firearm when the component is properly installed in the firearm and the firearm is held in a normal firing positon. Finally, for example, the bottom/lower edge or surface of a component refers to that edge or surface of the component that is nearest or facing the bottom of the firearm when the component is properly installed in the firearm and the firearm is held in a normal firing positon.

Figure 2:
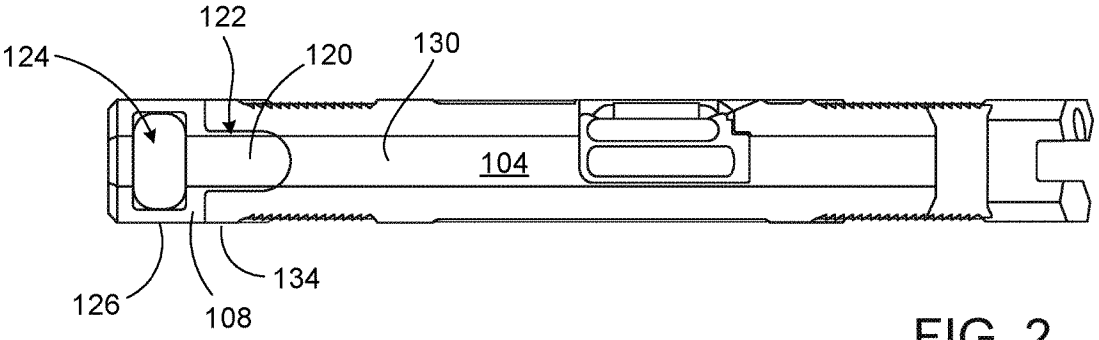
FIG. 2 depicts a top view of the firearm of FIG. 1.
Figure 3:
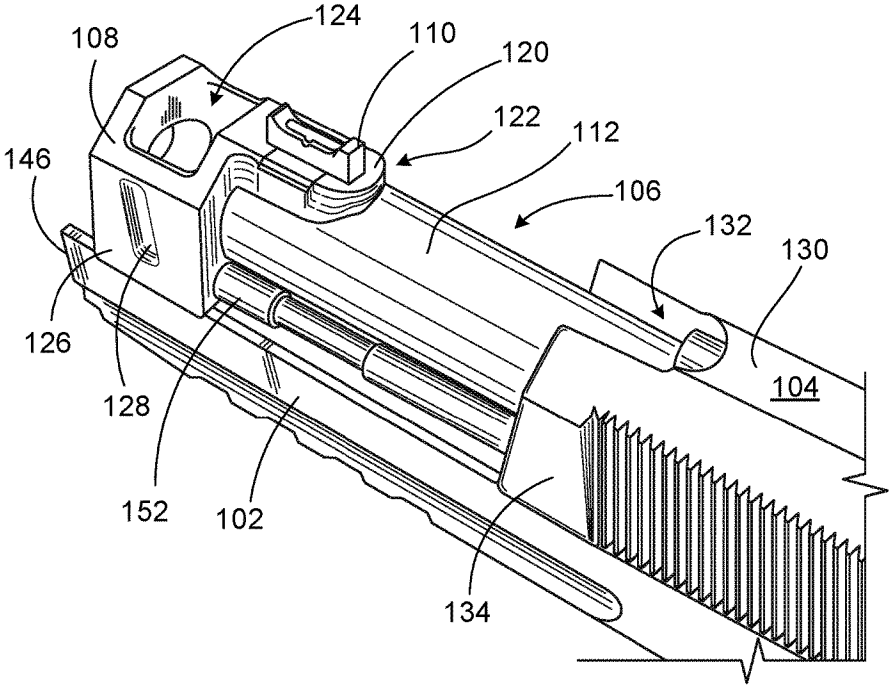
FIG. 3 depicts a perspective view of the firearm of FIG. 1 with the slide in a rearward position.
Figure 4:
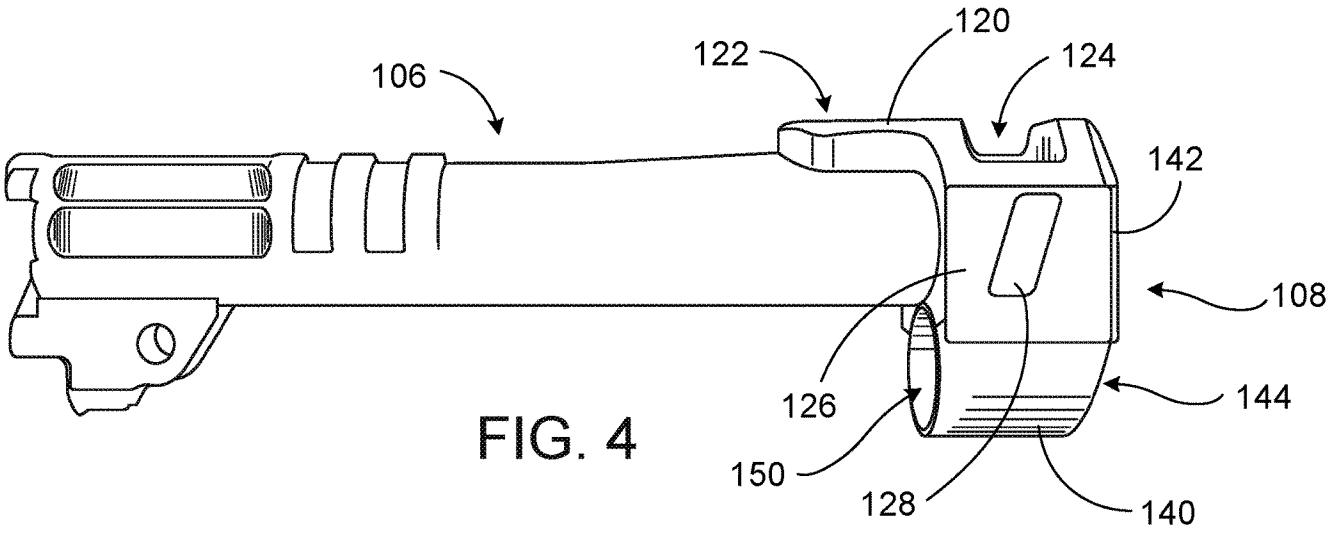
FIG. 4 depicts a side view of an exemplary barrel and compensator.
Figure 5:
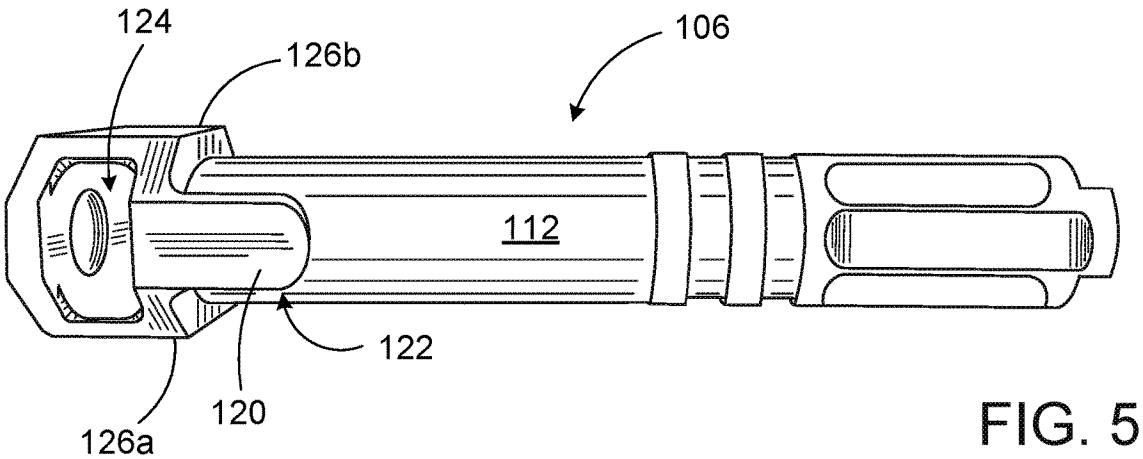
FIG. 5 depicts a top view of the exemplary barrel and compensator.

FIGS. 1-3 depict various views of a firearm 100 with an integrated compensation system in accordance with implementations of the present disclosure. Firearm 100 includes a frame 102, a slide 104, a barrel 106, and a compensator 108. Slide 104 is slidably attached to frame 102. That is, slide 104 is coupled to frame 102 such that it is free to slide along frame 102 during operation of the firearm 100. Barrel 106 is housed within slide 104. And, compensator 108 is attached to the muzzle end of the barrel 106. In some implementations, compensator 108 is threaded onto the end of barrel 106. In some implementation, compensator 108 is welded onto barrel 106. In some implementations, compensator 108 and barrel 106 are machined together from a single piece of metal stock (e.g. steel). For example, the combined barrel 106 and compensator 108 shown in FIGS. 4 and 5 is an example of a compensator 108 and barrel 106 that are machined together from a single piece of metal stock.

FIG. 2 shows firearm 100 with the slide 104 in a closed position (also referred to as being in battery or in a battery position). FIG. 3 shows firearm 100 with the slide 104 in a rearward position. FIGS. 4 and 5 depict side and top view of barrel 106 and compensator 108 removed from slide 104. Referring to FIGS. 2-5, compensator 108 includes one or more gas ports 124 and 128. Gas port 124 is formed as an aperture defined within the upper surface 120 of the compensator 108. Gas ports 128 are formed as apertures defined within left and right side surfaces 128 of compensator 108. Gas ports 124 and 128 direct a portion of the gasses that are generated during the discharge of a cartridge out of the upper and side surfaces of the compensator to create forces that counteract the recoil and muzzle rise of the firearm 100.

Compensator 108 also includes a projection 122 that extends rearward along an upper surface 112 of barrel 106 away from the muzzle. Projection 122 also extends away from gas port 124 along the top of barrel 106. As shown more clearly in FIGS. 4 and 5, projection 122 extends along the upper surface of barrel 106 and in a direction away from the muzzle end and towards the chamber end of the barrel 106.

Projection 122 provides a fixed surface behind the compensator ports 124 and 128 on which to mount a front sight 110. For example, projection 122 can be formed as an island structure of compensator 106 that is, at least partially, surrounded by slide 104, when the slide is in battery. For example, projection 122 provides an island along the barrel 106 on which to mount front sight 110. As shown, front sight 110 can be mounted to the upper surface 120 of compensator projection 122. Furthermore, by mounting the front sight on projection 122, the front sight 110 can be behind and spaced apart from gas port 124, thereby, preventing gases and muzzle flash from obscuring a user's view of the front sight.

The upper surface 130 of slide 104 includes a slot 132 that is shaped to correspond with the shape of the compensator projection 122. For example, slot 132 is shaped to allow the slide 104 to at least partially wrap around compensator projection 122 when the slide is in battery. In some implementations, such as that shown in the figures, slot 132 is shaped to allow the slide 104 to completely surround compensator projection 122 when the slide is in battery (e.g., as shown in FIG. 2).

Furthermore, the combination of the compensator projection 122 and correspondingly shaped slot 132 in the slide 104 may function together to further reduce the muzzle rise of the firearm 100 relative to a similar firearm with a traditional compensator. For example, the combined projection 122 and slot 132 maintains a constant weight for the barrel 106 and the slide 104 together, but redistributes a portion of the weight from the slide 104 to the front of the barrel 106. Because the barrel 106 does not move, or only move minimally as compared to the slide 104, the dynamic weight of the combined slide and barrel is decreased. That is, the amount of weight that is in motion during recoil is decreased. Because the rearward momentum of the slide 104 during recoil contributes to the felt recoil of the firearm 100 and the muzzle rise, the reduction in momentum of the slide 104 may aid in reducing both. At the same, the projection 122 shifts weight to the muzzle end of the firearm 100 that would not otherwise be there when the slide 104 in the rearward position during recoil. This additional weight may serve to add an additional downward moment on the front end of the firearm at the time when it is most needed. For example, when the slide 104 is in the rearward position during recoil, at which point its effect on muzzle rise is most significant, the projection 122 and slot 132 together provide a combined effect that both reduces the slides impact on muzzle rise due to rearward momentum and also provides and added weight at the front of the firearm 100 to aid in further reducing muzzle rise.

In some implementations, the upper surface 120 of the compensator 108 and compensator projection 122 is substantially flush with the upper surface 130 of slide 104 (e.g., as shown in FIGS. 1-3). In some implementations, the side surfaces 126 of the compensator 108 are substantially flush with the side surfaces 134 of the slide 104. For example, maintaining the upper and side surfaces of the compensator and slide flush may minimize edges that might catch on a user's clothing or gear.

Referring to FIGS. 1, 3, and 4, in some implementations, a lower portion 140 of the compensator 108 is recessed to fit within a front portion of frame 102. The recessed lower portion 140 of compensator 108 may permit frame 102 to overlap the lower portion 140. The lower portion 140 can be recessed by a distance comparable to the thickness of the frame 102 such that side surfaces 126 of compensator 108 are substantially flush with frame 102. In some implementations, frame 102 can extend to be substantially flush with the front surface 142 of compensator 108. In some implementations, a front surface 144 of lower portion 140 is substantially flush with a front surface 146 of frame 102. In some implementations, the lower portion 140 of compensator 108 includes a hole 150 sized to accept a guide rod 152 for a recoil spring.

Figure 6:
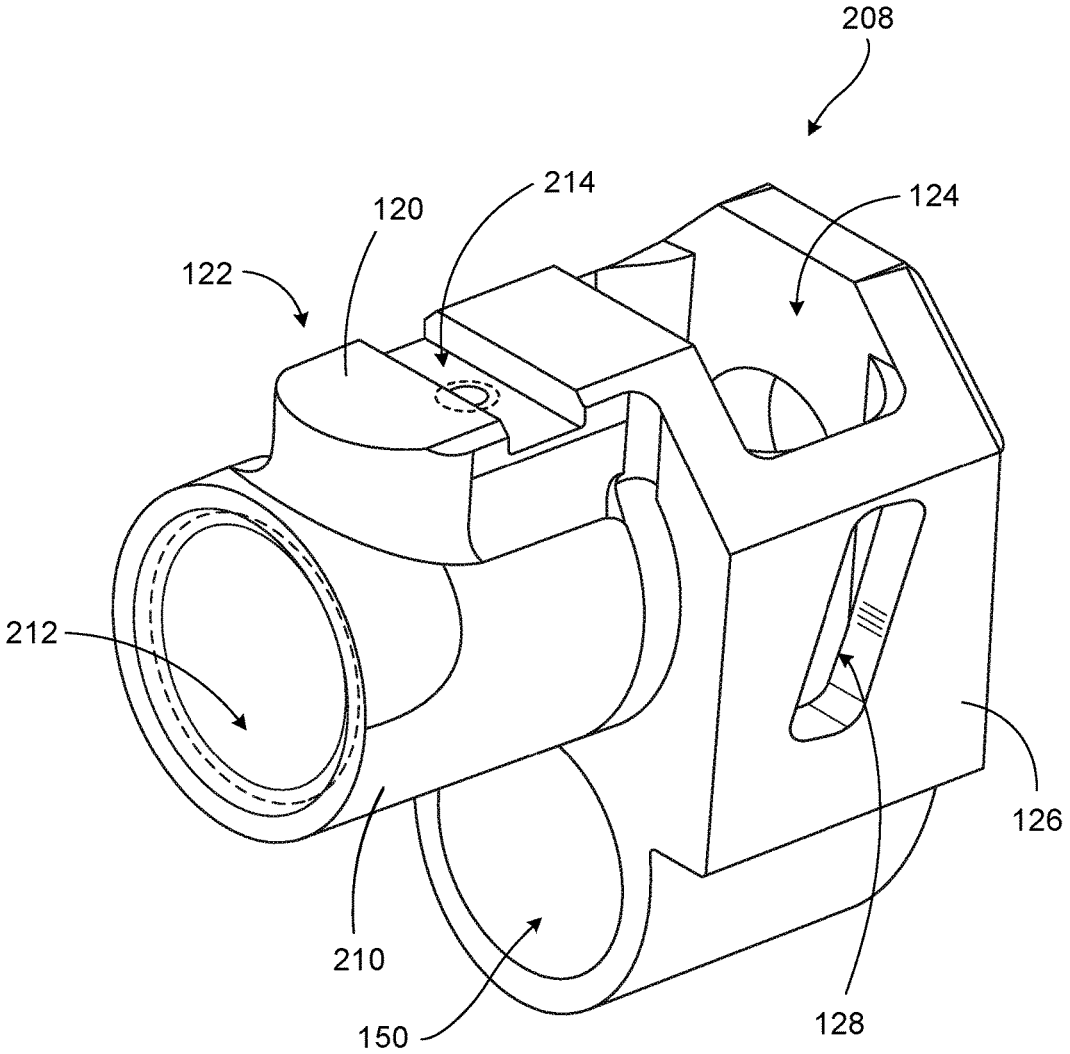
FIG. 6 depicts a perspective view of an exemplary separable compensator.

FIG. 6 depicts a perspective view of an exemplary separable compensator 208. For example, compensator 208 is machined separately from barrel 106. Compensator 208 can be threaded or welded onto barrel 106. Compensator 208 is generally similar to compensator 108 shown in FIGS. 1-5. Compensator 208 includes projection 122, and gas ports 124 and 128. In addition, compensator 208 includes a collar 210 sized to fit around the outside of barrel 106. That is, an inner diameter of collar 210 may match or be slightly larger than an outer diameter of barrel 106. Similar to compensator 108, projection 122 on compensator 208 still extends away from the gas ports 124 and 128. Furthermore, compensator 208 is designed to be installed on barrel 106 by placing collar 210 around the muzzle end of the barrel. As such, when installed, projection 122 will extend along the upper surface of barrel 106 towards the chamber end of the barrel 106.

Collar 210 can have a smooth inner surface 212. In which case, collar 210 can be welded onto barrel 108. In some implementations, the inner surface 212 of collar 210 can be threaded to match threading on barrel 106.

In some implementations, projection 122 may include a groove 214. A front sight 110 can be mounted in the groove. For example, groove 214 can be a dovetail groove.

A recoil compensation system for a firearm can be manufactured by providing a barrel, a compensator, and a slide. The compensator includes a projection extending away from gas ports in the compensator. The slide has a slot in the upper surface that is shaped to correspond with the shape of the compensator projection. The compensator is attached to muzzle end of the barrel such that the compensator projection extends along the barrel and in a direction that is away from the gas ports in the compensator and towards a chamber end of the barrel. For example, the compensator is installed such that the projection overlaps the barrel and extends away from the muzzle and towards the end of the barrel at which the chamber is located. The barrel is installed in the slide such that the compensator projection engages with the slot in the upper surface of the slide when the barrel is fully inserted in the slide. In other words, when the barrel is fully inserted in the slide, the slot allows the slide to wrap, at least partially, around the compensator projection. A front sight is mounted to the upper surface of the projection.

While a number of examples have been described for illustration purposes, the foregoing description is not intended to limit the scope of the invention, which is defined by the scope of the appended claims. There are and will be other examples and modifications within the scope of the following claims.

What is claimed is:

1. A firearm comprising:

a frame;

a barrel;

a compensator attached to a muzzle end of the barrel, the compensator comprising a projection extending along an upper surface of the barrel and in a direction away from the muzzle end of the barrel;

a slide slidably coupled to the frame and housing the barrel, wherein a slot is defined in an upper surface of the slide and the slot is shaped to allow the slide to, at least partially, wrap around the projection with the slide in a battery position; and a sight mounted to an upper surface of the projection.

2. The firearm of claim 1, wherein the upper surface of the slide is substantially flush with the upper surface of the projection.

3. The firearm of claim 1, wherein side surfaces of the compensator are substantially flush with side surfaces of the slide.

4. The firearm of claim 1, wherein the compensator comprises a gas port defined within the upper surface of the compensator.

5. The firearm of claim 4, wherein the sight is spaced apart from and rearward of the gas port.

6. The firearm of claim 1, wherein the compensator comprises a gas port defined within the upper surface of the compensator, a gas port defined within each of a right side surface and a left side surface of the compensator.

7. The firearm of claim 1, wherein the slot is shaped to allow the slide to completely surround the projection.

8. The firearm of claim 1, wherein the compensator and barrel are machined together from a single piece of metal.

9. The firearm of claim 1, wherein the compensator is threaded on the barrel.

10. The firearm of claim 1, wherein a portion of the frame extends around a bottom portion of the compensator.

11. The firearm of claim 10, wherein a front surface of the frame is substantially flush with a front surface of the compensator.

12. The firearm of claim 1, wherein the upper surface of the slide is substantially flush with the upper surface of the projection, and wherein side surfaces of the compensator are substantially flush with side surfaces of the slide, and wherein a front surface of the frame is substantially flush with a front surface of the compensator.

13. A firearm recoil compensation system comprising:

a barrel;

a compensator attached to a muzzle end of the barrel, the compensator comprising a projection extending along an upper surface of the barrel and in a direction away from gas ports in the compensator; and a slide configured to house the barrel, wherein a slot is defined in an upper surface of the slide and the slot is shaped to allow the slide to, at least partially, wrap around the projection with the slide in a battery position.

14. The system of claim 13, further comprising a sight mounted to an upper surface of the projection.

15. The system of claim 13, wherein the upper surface of the slide is substantially flush with the upper surface of the projection, and wherein side surfaces of the compensator are substantially flush with side surfaces of the slide.

16. The system of claim 13, wherein the compensator comprises a gas port defined within the upper surface of the compensator.

17. The system of claim 16, further comprising a sight mounted to an upper surface of the projection and wherein the sight is spaced apart from and rearward of the gas port.

18. The system of claim 13, wherein the compensator comprises a gas port defined within the upper surface of the compensator, a gas port defined within each of a right side surface and a left side surface of the compensator.

19. The system of claim 13, wherein the slot is shaped to allow the slide to completely surround the projection.

20. A method of manufacturing a firearm compensation system comprising:

attaching a compensator to a muzzle end of a barrel, the compensator comprising a projection, wherein the compensator is attached such that the projection extends along the barrel and in a direction that is away from gas ports in the compensator and towards a chamber end of the barrel;

installing the barrel in a slide, wherein a slot is defined in an upper surface of the slide and the slot is shaped to allow the slide to, at least partially, wrap around the projection with barrel fully inserted in the slide; and mounting a front sight to an upper surface of the projection.

* * * * *